US005501418A

United States Patent [19]

Humphrey et al.

[11] Patent Number: 5,501,418

[45] Date of Patent: Mar. 26, 1996

[54] SWITCH POINT ROLLER ASSIST APPARATUS

[76] Inventors: John Humphrey, R.R. 1, Box 131, Walnut, Iowa 51577; Dean Wieser, 4416 S. 34th St., Omaha, Nebr. 68107

[21] Appl. No.: 316,844

[22] Filed: Oct. 3, 1994

[51] Int. Cl.[6] ..... E01B 7/00

[52] U.S. Cl. ..... 246/453

[58] Field of Search ..... 246/415 R, 430, 246/435 R, 442, 453

[56] References Cited

U.S. PATENT DOCUMENTS

| | | | |
|---|---|---|---|
| 726,613 | 4/1903 | Anderson . | |
| 1,455,996 | 5/1923 | Einstein . | |
| 1,965,803 | 7/1934 | Post et al. | 246/453 |
| 2,177,148 | 10/1939 | Newhall | 287/58 |
| 2,471,357 | 5/1949 | Smith | 246/453 |
| 2,533,929 | 12/1950 | Gray et al. | 246/453 |
| 3,099,427 | 7/1963 | Brown | 246/453 |
| 3,952,481 | 4/1976 | Albertsen | 53/392 |
| 4,059,054 | 11/1977 | Alimanestianu et al. | 104/88 |
| 5,390,881 | 2/1995 | Benenowski et al. | 246/453 |

FOREIGN PATENT DOCUMENTS

| | | | |
|---|---|---|---|
| 1056641 | 2/1957 | Germany | 246/453 |
| 325977 | 3/1930 | United Kingdom . | |
| 415153 | 9/1934 | United Kingdom . | |

*Primary Examiner*—Robert J. Oberleitner
*Assistant Examiner*—S. Joseph Morano
*Attorney, Agent, or Firm*—Adam H. Jacobs

[57] ABSTRACT

A switch point roller assist apparatus includes an elongated main support structure on which is movably mounted a rail securement clamp for releasably adjustably connecting the main support structure to a railroad rail. An elongated tie bar is adjustably mounted on the main support structure generally perpendicular to the main support structure. A roller support cage is pivotally adjustably mounted on the main support structure, the roller support cage supporting at least one roller rotatably mounted thereon, each roller mounted generally perpendicular to the main support structure. The tie bar is adjustably mounted to the main support structure such that the position of the tie bar is vertically adjustable relative to the main support structure. Finally, the roller support cage is adjustably mounted on the main support structure such that the position of the rollers is vertically adjustable relative to the main support structure.

13 Claims, 4 Drawing Sheets

SWITCH POINT ROLLER ASSIST APPARATUS

BACKGROUND OF THE INVENTION

1. Technical Field

This invention relates to switch point assist devices for railroads and, more particularly, to a switch point roller assist apparatus for attachment to a railroad rail at a switching location which includes a main support structure, a rail securement clamp adjustably mounted on the main support structure, an elongated tie bar adjustably mounted on the main support structure and generally perpendicular thereto and a roller support cage on which at least one roller is rotatably mounted, the roller support cage pivotally mounted on the main support structure such that the rollers may be adjusted vertically relative to the main support structure.

2. Description of the Prior Art

Railroad switching devices usually comprise tapered metal blades or tongues which set alternative routes of running rails. The term "turnout" is also used to denote a curved track leading from one track to another which takes place at a switching point. The commonest form of switch is the split switch in which one rail of the main track and the outer rail of the turnout are continuous. The point rails are connected respectively to the second rail of the main track and the inner rail of the turnout. The switch operates in the following manner: when the point rail connected to the second rail of the main track is in contact with the outer rail of the turnout, a locomotive traveling on the main track will continue on the main track; when the point rail connected to the inner rail of the turnout is in contact with the first rail of the main track, a locomotive traveling on the main track will be switched over to the turnout. The point rails are spaced such that in no circumstances can both point rails be in contact with an adjacent rail of the main track or of the turnout. To secure the point rails in a particular spaced apart dimension, switch rods are provided extending between the point rails and mounted towards the tapered ends of each point rail.

To switch the point rails from contact with one rail of the main track to contact with the outer rail of the turnout and vice versa, both hand-operated and power-assisted switches are used. However, in both types of switches, the tapered ends of the point rails rest on a flat metal plate over which the ends of the point rails are slid. Clearly, if a power-assisted switch is being used, the amount of force needed to move the point rails is not critical, as the force is provided by hydraulics or the like. However, in a standard hand-operated switch, a large amount of force may be required to slide the point rails over the metal plate from contact with one rail to another due to the friction between the point rails and metal plate. The intense effort required to move the point rails thus may result in muscle strains or back injuries to the operator of the hand-operated switch. There is therefore a need for devices which will remove the point rails from contact with the metal plate while the point rails are being moved, yet return the point rails to contact with the metal plate upon being moved into correct position.

One well-known device for assisting movement of the point rails is the switch point assist roller manufactured by various companies. Such roller assist devices commonly include an extended C-channel main support section, a tie bar mounted generally perpendicular to the C-channel at one end of the C-channel, a clamping device for securing the opposite end of the C-channel to the outer flange of a rail and one or more rollers rotatably mounted in the C-channel generally perpendicular thereto. The rollers are intended to lift the point rail slightly above the metal plate such that the point rail may be slid across the rollers. However, one of the problems still encountered with the point rollers' other prior art is that a good deal of force must be applied to slide the point rail up onto the first roller, due to the fact that the first roller is above the level of the metal plate. Thus, while the total amount of force needed to move the point rails is lowered by the devices found in the prior art, the initial force which must be applied is often at least as great as would be encountered if no point roller assist device were present. It is widely known that brief periods of intense exertion cause most muscle sprains and back injuries, and the point roller assist devices of the prior art do not completely address and solve this problem.

Another problem encountered with those devices found in the prior art is that in many cases, switch locations are high-traffic areas. Therefore, irregularities in the ties and rails may be present at the location where the switch point assist apparatus is to be located. Various examples are found in the prior art which attempt to address irregular rails and ties, such as including a number of shims underneath the tie bar or other such methods. However, none of these methods can be employed once the switch point assist apparatus is in place on the rail. There is therefore a need for an adjustment means which can be adjusted to fit the various irregularities encountered on the rail bed after the switch point assist apparatus is installed on the rail.

A further disadvantage of the prior art is found in the clamp device which secures the switch point assist apparatus to the rail. One of the common problems encountered in prior art clamps is that the clamp plate which contacts the rail flange is frictionally secured to the flange but is not frictionally secured to the C-channel. This results in the clamp plate sliding off of the rail flange incrementally each time the main rail vibrates (i.e. when a locomotive runs over the track). Eventually, the clamp plate will either be dislodged from the rail flange, resulting in the switch point assist roller falling from the main rail, or require periodic repositioning to the original location of the plate. There is therefore a need for a clamp which will not slide off of the rail flange due to vibrations of the rail.

Therefore, an object of the present invention is to provide an improved switch point roller assist apparatus.

Another object of the present invention is to provide a switch point roller assist apparatus which includes an adjustable tie bar and adjustable height rollers in a roller support cage which is pivotally mounted to the main support structure.

Another object of the present invention is to provide a switch point roller assist apparatus which includes an adjustable clamp mechanism which can be frictionally secured on the main support structure to prevent the clamp plate from sliding off of the rail flange.

Another object of the present invention is to provide a switch point roller assist apparatus in which the rollers mounted on the roller support cage may be moved separately from the main support structure and may be adjusted after the switch point roller assist apparatus is installed on the rail.

Another object of the present invention is to provide a switch point roller assist apparatus which may be mounted on irregular rails and ties yet still provide assistance for movement of the point rails and operation of the switch.

Finally, an object of the present invention is to provide a switch point roller assist apparatus which is relatively simple and sturdy in construction and safe and efficient in use.

SUMMARY OF THE INVENTION

The present invention provides a switch point roller assist apparatus for attachment to a railroad rail at a switching location which includes an elongated main support structure having a center longitudinal axis and inner and outer ends. A rail securement clamp is adjustably mounted on the main support structure adjacent the outer end for releasably adjustably connecting the main support structure to the lower flange of a railroad rail. Mounted on the main support structure adjacent the inner end is an elongated tie bar which extends generally perpendicular to the center longitudinal axis of the main support structure, the tie bar adapted to be connected to two adjacent railroad ties on a railroad bed. A roller support cage is adjustably mounted on the main support structure, the roller support cage supporting at least one roller having a center rotational axis, the roller rotatably mounted on the roller support cage such that the center rotational axis is generally perpendicular to the center longitudinal axis of the main support structure. The elongated tie bar is adjustably mounted on the main support structure such that the position of the tie bar is vertically adjustable relative to the main support structure. Finally, the roller support cage is adjustably mounted on the main support structure such that the position of the roller or rollers is vertically adjustable relative to the main support structure.

The present invention thus provides a switch point roller assist apparatus which is superior in many ways to those switch point roller assist devices found in the prior art. For example, the rail securement clamp may be frictionally secured on the main support structure, thus preventing slippage of the clamp plate off of the rail flange which it engages. Additionally, because the tie bar may be vertically and pivotally adjusted relative to the main support structure, the switch point roller assist apparatus of the present invention may be securely fastened to irregular ties or where one of the two ties has settled into the rail bed more than the other tie, thus resulting in an uneven securement point. Possibly the most important improvement in the present invention over the prior art is the adjustable roller support cage which supports the one or more rollers therein. The adjustable roller support cage allows for adjustment of the roller height after the main support structure has been securely fastened in place on the rail and to the two adjacent railroad ties, without requiring movement of any of the main support structure or tie bar. It is relatively common to find that one or both point rails at a particular switch are either above or below the standard position for point rails, due to wear and/or installation irregularities. To properly raise the point rail above the metal plate on which the point rails sit, it is often necessary to adjust the vertical location of the assist rollers. The present invention provides a novel, unique and efficient system for accommodating such vertical adjustment. Therefore, it is seen that the present invention provides a substantial improvement over those point roller assist devices found in the prior art.

DESCRIPTION OF THE PREFERRED EMBODIMENT

The switch point roller assist apparatus 10 of the present invention is best shown in FIGS. 1–6 as including an elongated main support structure 12 which is preferably constructed as a generally rectangular frame having first and second side bars 14 and 16 and inner and outer end bars 18 and 20. In a preferred embodiment, the side bars 14 and 16 and end bars 18 and 20 would be constructed of steel flats having a height of approximately two inches and a width of approximately ⅜ of an inch. The first and second side bars 14 and 16 preferably have a length of approximately 20–26 inches, whereas the end bars 18 and 20 preferably have a length of approximately 4–6 inches. Of course, these dimensions are not critical to the present invention and may vary depending upon railroad specifications and installation and functional requirements. It is also preferred that side bars 14 and 16 and end bars 18 and 20 be connected to one another by welding or any other suitable connection means.

Figure 1:
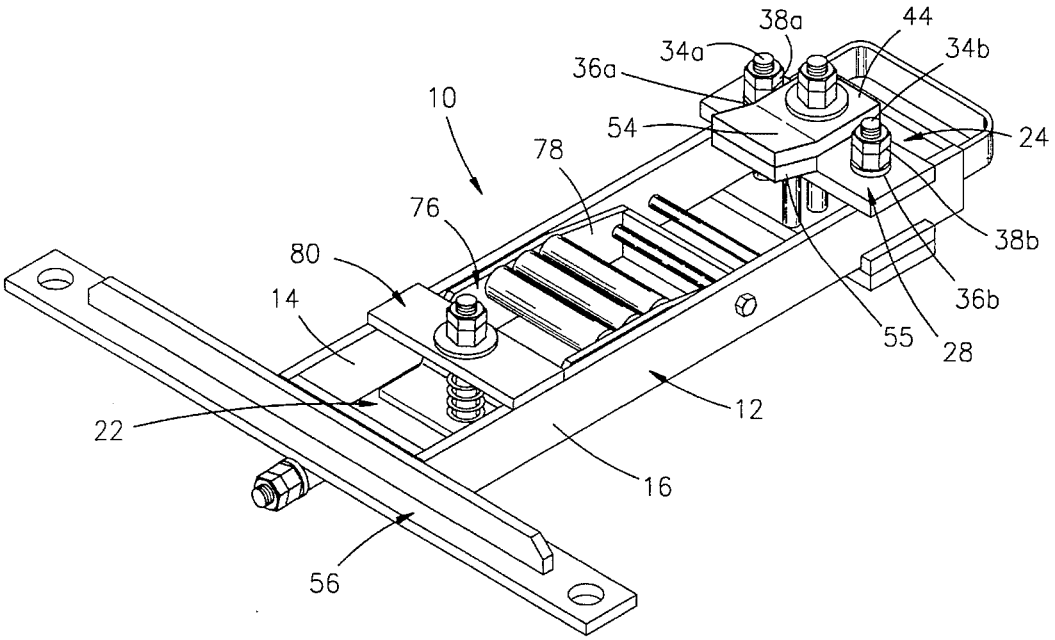
FIG. 1 is a perspective view of a first embodiment of the present invention.
Figure 3:
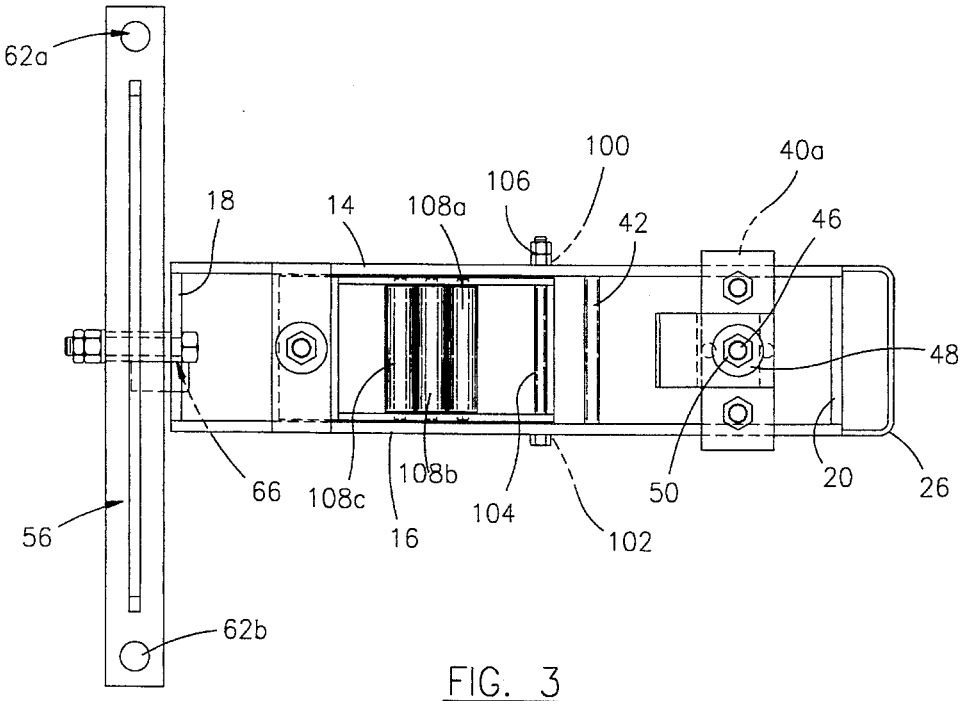
FIG. 3 is a top plan view of the embodiment of FIG. 1.

Mounted on the outer end 24 of the main support structure 12 is a handle 26, which is preferably a generally U-shaped section of flat steel welded at each end to each of the first and second side bars 14 and 16, as shown in FIGS. 1 and 3.

Figure 6:
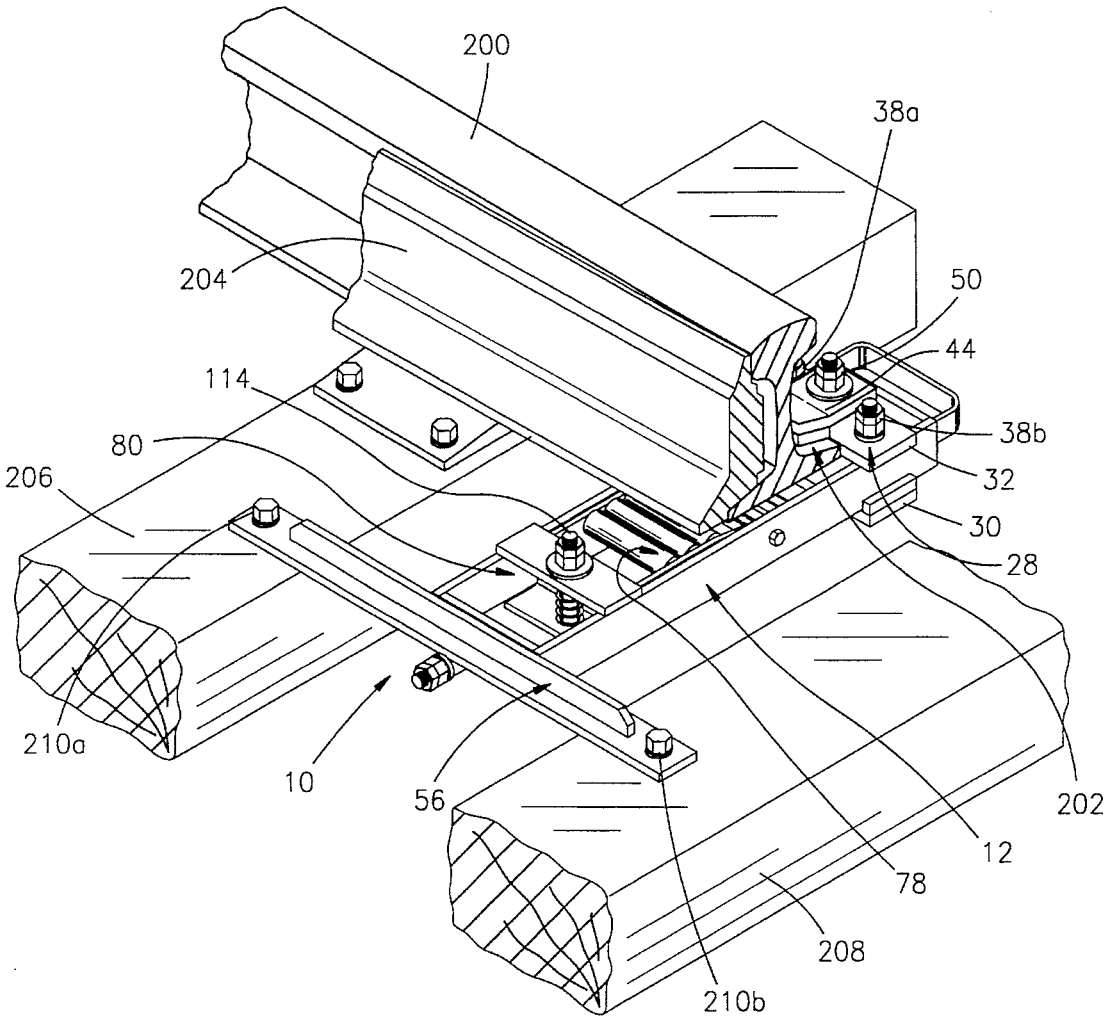
FIG. 6 is a perspective view of the embodiment of FIG. 1 mounted on a railroad rail and adjacent ties.

Adjustably and movably mounted on the main support structure 12 adjacent the outer end 24 thereof is a rail securement clamp 28 which is used to secure the switch point roller assist apparatus 10 to the flange 202 of a railroad rail 200, as shown in FIG. 6. The rail securement clamp 28 is best shown in FIGS. 3 and 6 as including a base plate 30 and a top plate 32 each of which extend generally parallel with one another and generally perpendicular to the center longitudinal axis of the main support structure 12. It is preferred that the base plate 30 and top plate 32 each be approximately one inch longer than the inner and outer end bars 18 and 20 such that the base plate 30 and top plate 32 extend outwards past the outer edge of each of the first and second side bars 14 and 16, as shown in FIG. 3. The base plate 30 and top plate 32 are secured to one another by two bolts **34*a* and 34*b* which extend upwards from beneath the base plate 30 through base plate 30 upwards through top plate 32 and are secured in place by washers 36*a* and 36*b* and double nuts 38*a* and 38*b*. As used herein, the term "double nuts" will commonly refer to a nut and jam nut combination. Alternatively, double nuts 38*a* and 38*b* and washers 36*a* and 36*b* may be replaced by locknuts using nylon bushings or the like, so long as the securement means used to secure the base plate 30 and top plate 32 to the main support structure 12 will reliably lock the clamp 28 in place. Of course, when base plate 30 and top plate 32 are drawn towards each other by tightening of double nuts 38*a* and 38*b*, base plate 30 and top plate 32 may bow towards one another in the center of each plate. To prevent this, and to provide additional structural rigidity to the entire clamp structure, two clamp spacer rods 39***a* and 39*b* extend between and are connected to one or the other of base and top plates 30 and 32. It is preferred that clamp spacer rods 39*a* and 39*b* have a length slightly less than the height of the first and second side bars 14 and 16 such that base plate 30 and top plate 32 are prevented from substantially deflecting upon tightening of double nuts 38*a* and 38*b*.

Mounted on the top surface of base plate 30 externally of first and second side bars 14 and 16 are a pair of guide blocks 40*a* and 40*b* which cooperate with the base plate 30 and top plate 32 to secure the rail securement clamp 28 on the main support structure 12 and prevent rotation of the clamp 28. The top plate 32 and base plate 30 thus sandwich the first and second side bars 14 and 16 between the plates and the guide blocks 40*a* and 40*b* prevent the base plate 30 from rotating on the main support structure 12. Therefore, movement of the rail securement clamp 28 is allowed only parallel with the center longitudinal axis of the main support structure 12.

The rail securement clamp 28 is secured in place on the main support structure 12 by tightening of double nuts 38*a* and 38*b* which pulls base plate 30 towards top plate 32 and thus frictionally secures clamp 28 in a particular position on the main support structure 12. Movement towards the outer end 24 of main support structure 12 is restricted by outer end bar 20, whereas movement towards the inner end 22 of main support structure 12 is restricted by spacer rod 42 which extends between and is connected to first and second side bars 14 and 16, which also acts to secure first and second side bars 14 and 16 in spaced position.

Figure 2:
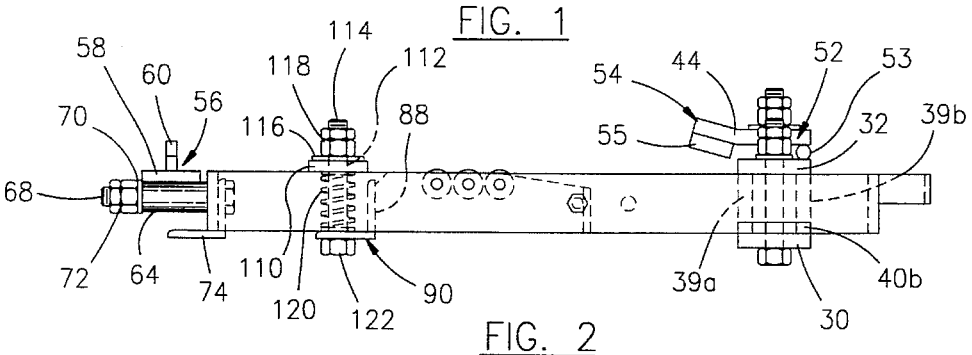
FIG. 2 is a side elevational view of the embodiment of FIG. 1.
Figure 8:
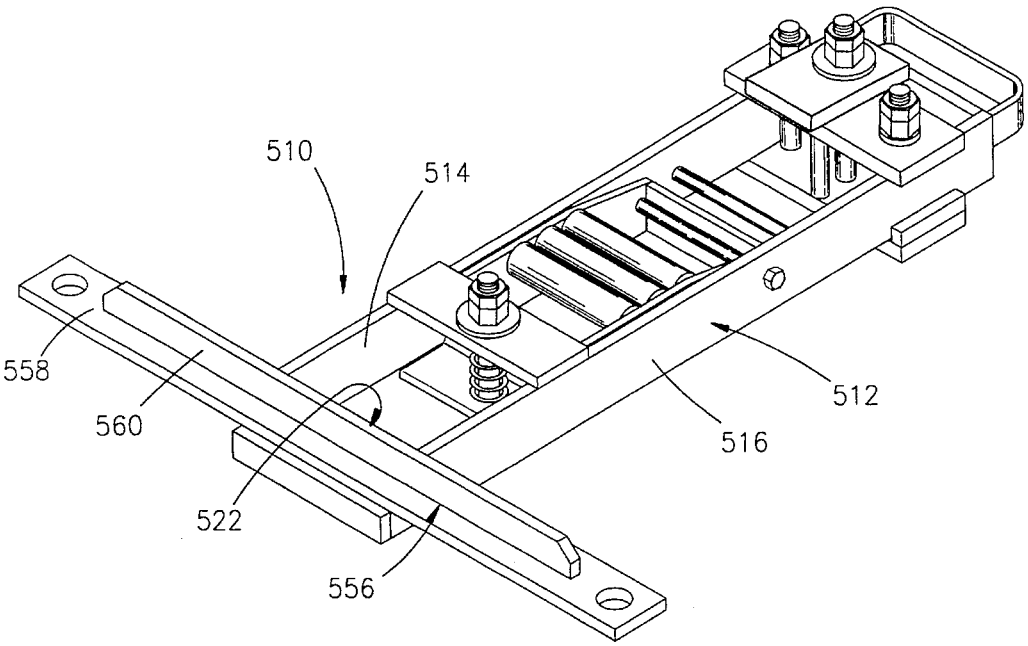
FIG. 8 is a perspective view of a second embodiment of the present invention.

Mounted above top plate 32 on rail securement clamp 28 is a rail flange engagement plate 44 which is adjustably secured to rail securement clamp 28 by bolt 46 which extends upwards from beneath base plate 30 through base plate 30, through top plate 32, through rail flange engagement plate 44 and is secured in place by a washer 48 and double nut 50, as shown best in FIGS. 1 and 2. Rail flange engagement plate 44 includes a generally flat base section 52 under which is mounted a pivot rod 53 and an upwardly tilted flange-engaging section 54 which extends inwards past the edge of top plate 32 towards inner end 22 of main support structure 12. It is preferred that flange-engaging section 54 be upwardly tilted to better engage the flange 202 of main rail 200, and further include a generally rectangular flange-engaging block 55 as shown in FIGS. 3 and 6. However, flange-engaging section 54 also may extend inwards parallel with the base section 52, as shown in FIG. 8, so long as at least part of the flange-engaging section 54 engages the flange 202 of a rail 200. The method by which rail securement clamp 28 engages main rail 200 will be discussed later in this disclosure.

Adjustably mounted at the inner end 22 of main support structure 12 is an elongated tie bar 56, which extends generally perpendicular to the center longitudinal axis of the main support structure 12. Tie bar 56 preferably includes a generally rectangular flat bar 58 to which is vertically perpendicularly mounted a stiffening beam 60 as shown in FIGS. 1–3. It is preferred that flat bar 58 have a longitudinal length of between 20 and 24 inches, a transverse width of approximately two inches and a height of approximately ⅜ of an inch. It is preferred that stiffening beam 60 have a longitudinal length of approximately 12–20 inches, a transverse width of approximately ⅜ of an inch and a height of approximately one inch. It is preferred that stiffening beam 60 be welded to flat bar 58 to prevent substantial bending or bowing of flat bar 58 in response to force applied at the midpoint of the flat bar 58. It is also preferred that flat bar 58 further include lag holes 62*a* and 62*b* punched at opposite ends of flat bar 58 and extending transversely therethrough, the lag holes 62*a* and 62*b* being of sufficient size and shape to allow a lag to be inserted therethrough to secure the tie bar 56 to adjacent railroad ties 206 and 208, as shown in FIG. 6.

Mounted to the underside of flat bar 58 is a bolt sleeve 64, which is preferably a metal cylinder having a center longitudinal axis extending parallel with the center longitudinal axis of the main support structure 12 such that the bolt sleeve 64 is mounted generally perpendicular to flat bar 58 and on the underside thereof. It is preferred that bolt sleeve 64 be secured to flat bar 58 by welding or other such connection means.

Punched in inner end bar 18 of main support structure 12 is a generally vertical slot 66, the slot 66 being aligned with the center longitudinal axis of the main support structure 12 and being generally oval in shape with a height of approximately one inch and a width of approximately ½–¾ inches. A bolt 68 extends through slot 66 and through bolt sleeve 64, the bolt 68 being secured in place by a washer 70 and double nut 72. It is preferred that the inner diameter of bolt sleeve 64 be slightly larger than the outer diameter of bolt 68 such that bolt sleeve 64 may freely rotate about bolt 68. The rotation of bolt sleeve 64, combined with the vertical adjustment provided by slot 66, allows the tie bar 56 to be mounted to adjacent railroad ties 206 and 208 regardless of the relative height and/or position of the ties. Additionally, the precise height of the switch point roller assist apparatus 10 below point rail 204 may be adjusted to engage misaligned point rails. It is important that the bolt 68 be of sufficient structural strength to support the weight of the point rail 204 being supported by the switch point roller assist apparatus 10.

Also mounted on the inner end 22 of main support structure 12 is an L-shaped metal bracket 74 mounted on the inner end bar 18 and extending inwards therefrom as shown in FIG. 2. L-shaped bracket 74 prevents free rotation of the tie bar 56, but can be replaced with any appropriate rotation prevention means.

Figure 4:
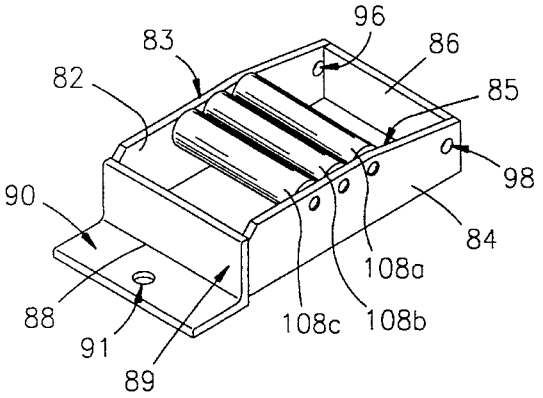
FIG. 4 is a partial detail perspective view of the roller support cage of the present invention.
Figure 5:
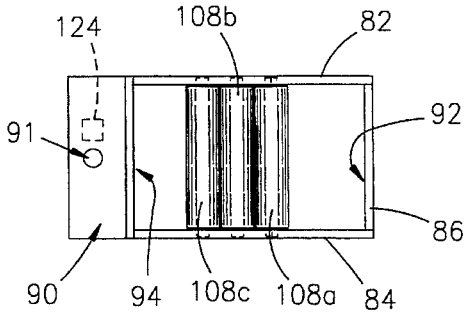
FIG. 5 is a partial detail top plan view of the roller support cage of the present invention.

Referring now to the central section of the main support structure 12, there is exhibited adjustable roller support structure 76 which includes a pivotally mounted roller support cage 78 and an adjustment structure 80. The roller support cage 78 is best shown in FIGS. 4 and 5 as including two generally parallel roller support side bars 82 and 84 and a cage end bar 86 which extends between and is connected to the left and right roller support side bars 82 and 84 adjacent the outer end 92 of roller support cage 78. It is preferred that each roller support side bar 82 and 84 be greater in height at the inner end 94 of the roller support cage 78 than at the outer end 92 of the roller support cage 78. This results in each roller support side bar 82 and 84 having a sloping upper surface 83 and 85, respectively. Alternatively, sloped upper surfaces 83 and 85 of roller support side bars 82 and 84 respectively would include a sloped section and a generally horizontal section, as shown in FIG. 4.

Mounted to each of the roller support side bars 82 and 84 at the inner end 94 of the roller support cage 78 is an L-shaped end bracket 88 having a generally vertical end wall section 89 and a generally horizontal adjustment structure connection section 90, as shown best in FIGS. 4 and 5. Connection section 90 further includes a generally vertical transverse hole 91 punched extending through the connection section 90, the hole 91 of sufficient size to accommodate a bolt 114 held within the adjustment structure 80. It is preferred that the roller support cage 78 be formed of high tensile strength metal and be approximately 7–8 inches in length and approximately 5 inches in width.

Punched adjacent the outer end 92 of each support side bar 82 and 84 is a bolt hole 96 and 98, respectively, each of which extends generally horizontally and transversely through the left and right side bars 82 and 84. FIGS. 1–3 best disclose how the roller support cage 78 is pivotally secured within the main support structure 12. First and second side bars 14 and 16 of main support structure 12 each further include a generally horizontal transverse hole 100 and 102, respectively, each approximately the same size as bolt holes 96 and 98. Pivot bolt 104 is inserted through hole 102 in right side bar 16 and through bolt hole 98 in right side bar 84 of roller support cage 78, bolt 104 extending across main support structure 12 and entering bolt hole 96 in left side bar 82 of roller support cage 78, then extending through and out of hole 100 in left side bar 14. The bolt 104 is secured in place by double nut 106, as shown in FIG. 3. Roller support cage 78 may thus pivot about pivot bolt 104, thus resulting in the inner end 94 of roller support cage 78 being adjusted upwards or downwards.

Roller support cage 78 further includes a plurality of point rail support rollers 108*a*, 108*b* and 108*c* which are preferably metal cylinders with internal bushings, the cylinders being approximately one inch in diameter each and rotatably mounted on the left and right roller support side bars 82 and 84, as shown in FIGS. 4 and 5. Of course, rollers 108*a*, 108*b* and 108*c* may be replaced by any suitable movement assisting means, such as a small conveyor belt or other type of roller device. It is preferred that rollers 108*a–c* be mounted in the roller support cage 78 such that the upper point rail contacting surface of each roller 108*a–c* extends slightly above the upper surface 83 and 85 of each roller support side bar 82 and 84. For this reason, when the roller support cage 78 is mounted in the main support structure 12, rollers 108*a–c* should be positioned such that the upper point rail contacting surface of each roller 108*a–c* extends slightly above the first and second side bars 14 and 16 of the main support structure such that each roller 108*a–c* may engage the point rail 204.

The inner end 94 of the roller support cage 78 is adjusted by the adjustment structure 80. Adjustment structure 80 includes a generally flat rectangular bolt securement plate 110 which is mounted on the first and second side bars 14 and 16 of main support structure 12, as shown in FIG. 1. Punched in bolt securement plate 110 is a bolt hole 112 which extends generally vertically and transversely through bolt securement plate 110 and is generally centered thereon. Bolt hole 112 is preferably generally vertically aligned with hole 91 in adjustment structure connection section 90 of L-shaped end bracket 88 on roller support cage 78, and is preferably of generally the same size. Adjustment bolt 114 extends upwards through bolt hole 91 in connection section 90 and through bolt hole 112 in bolt securement plate 110, and is secured in place by a washer 116 and double nut 118. A coil spring 120 is movably mounted on adjustment bolt 114 between the upper side of connection section 90 and the underside of bolt securement plate 110, the coil spring 120 insuring that connection section 90 is always in contact with the head 122 of adjustment bolt 114. Rotation of adjustment bolt 114 is prevented by a square block stop 124 mounted on the underside of connection section 90 which engages a side face of bolt head 122, as shown in FIG. 5. It is preferred that adjustment bolt 114 have sufficient structural strength to support one end of the roller support cage 78 when a point rail 204 is being supported thereon.

Adjustment of the vertical height of the inner end 94 of the roller support cage 78 relative to the main support structure 12 is accomplished by rotation of the double nut 118 on adjustment bolt 114 which moves bolt head 122 either up or down depending on the direction of rotation of double nut 118. Movement of bolt head 122 upwards causes connection section 90 to be pulled upwards, therefore moving the inner end 94 of roller support cage 78 upwards. Conversely, movement of bolt head 122 downwards causes inner end 94 of roller support cage 78 to likewise move downwards. The height of rollers 108*a–c* may thus be adjusted by rotation of the double nut 118 as described above.

Figure 7:
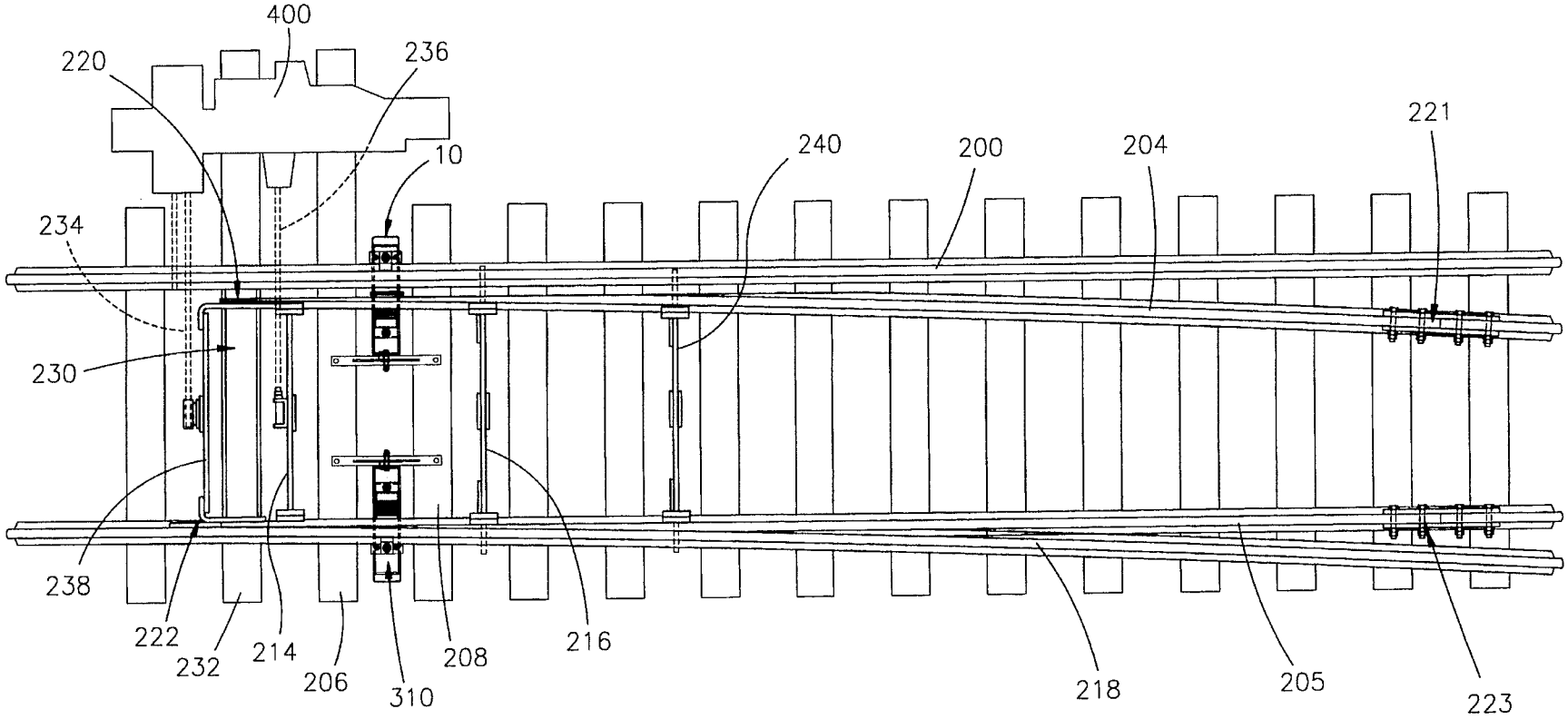
FIG. 7 is a top plan view of a common split switch showing the point rails and where the switch point roller assist devices of the present invention are placed to assist movement of the point rails.

The switch point roller assist apparatus 10 is mounted at a switching location as shown in FIGS. 6 and 7. FIG. 6 best discloses how the switch point roller assist apparatus 10 is secured in place. Specifically, the tie bar 56 is placed on two adjacent railroad ties 206 and 208 and the outer end 24 of the main support structure 12 is slid underneath point rail 204 and main rail 200. Double nut 50 on bolt 46 is loosened, thus allowing the rail engagement plate 44 to be moved upwards. The first and second side bars 14 and 16 of the main support structure are moved upwards until contacting the lower surface of main rail 200, and the rail securement clamp 28 is slid towards the inner end 22 of the main support structure 12 until flange-engaging section 54 of rail engagement plate 44 is positioned above the rail flange 202. The position of the rollers 108*a–c* with respect to the point rail 204 is adjusted by movement of the clamp 28 along first and second side bars 14 and 16 to bring first roller 108*a* into engagement with point rail 204. Once the rail securement clamp 28 is in a desired location on the first and second side bars 14 and 16, double nuts 38*a* and 38*b* are tightened, thus drawing base plate 30 towards top plate 32 and frictionally securing rail securement clamp 28 on first and second side bars 14 and 16. Following securement of rail securement clamp 28, rail engagement plate 44 is secured to the flange 202 of main rail 200 by engagement of flange-engaging section 54 of flange 202. Double nut 50 is tightened, thus forcing flange-engaging section 54 and flange-engaging block 55 into contact with flange 202 and thus clamping flange 202 between the flange-engaging block 55 and first and second side bars 14 and 16. Movement of clamp 28 is thus prevented due to the frictional securement of clamp 28 on first and second side bars 14 and 16, and therefore rail engagement plate 44 may not slide off of flange 202.

Slot 66 in inner end bar 18 allows the height of the tie bar 56 relative to the main support structure 12 to be adjusted to best fit onto adjacent railroad ties 206 and 208. Similarly, if one of the railroad ties is slightly higher than the other, bolt sleeve 64 allows for rotation of the tie bar 56 about the bolt 68 until both lag holes 62*a* and 62*b* engage their respective railroad ties 206 and 208. When the tie bar 56 is in the proper position, double nut 72 is securely tightened, thus restricting further movement of the tie bar 56 relative to main support structure 2. Lags 210*a* and 210*b* are then driven into lag holes 62*a* and 62*b* thus securing flat bar 58 to the adjacent railroad ties 206 and 208 and thus securely fastening the tie bar 56 in place.

Following the secure fastening of the switch point roller assist apparatus 10 in position, roller support cage 78 may be adjusted to bring rollers 108*a–c* into proper position to assist with movement of the point rail 204. In a majority of instances, the preset position of the rollers 108*a–c* will be adequate, however, many situations will arise where the point rail 204 is slightly above or below the optimum originally installed position. In these situations, double nut 118 on adjustment bolt 114 may be rotated to raise or lower the roller support cage 78 without further adjustment of the location of the main support structure 12. It is preferred that point rail 204 partially engage first roller 108*a* at all times to prevent the exertion required to raise the point rail 204 onto first roller 108*a*. It is preferred that second roller 108 be slightly higher than first roller 108*a* and that third roller 108*c* be slightly higher than second roller 108*b* in order to raise the point rail 204 above the rail tie plate 230 on which the point rail 204 normally rests.

FIG. 7 shows the preferred positioning of a pair of switch point roller assist apparati 10 and 310 mounted between adjacent railroad ties 206 and 208 which are between first switch rod 214 and second switch rod 216 which extend between and connect the point rails 204 and 205. Point rails 204 and 205 are also connected by point switch rod 238 and third switch rod 240. The first and second switch point roller assist apparati 10 and 310 are mounted to main rail 200 and outer turnout rail 218 as shown in FIG. 7 and as described above in connection with FIG. 6. Once the switch point roller assist apparati 10 and 310 are secured in place, the heights of their respective roller support cages are adjusted by the adjustment device described above such that the rollers of each switch point roller assist apparati 10 and 310 may engage the underside of the respective point rail 204 and 205. The switch 400 shown in FIG. 7 is a power-assisted switch, but it is to be understood that the present invention is designed to function with any switching device and in connection with a variety of switching locations.

As shown in FIG. 7, point rail 205 is adjacent to and in contact with outer turnout rail 218. This means that the tapered end 222 of point rail 205 is resting on railroad tie plate 230, which is preferably a heavy-gauge generally rectangular metal plate extending between outer turnout rail 218 and main rail 200 and is positioned on railroad tie 232. The weight of a locomotive passing over point rail 205 is thus transferred to railroad tie plate 230 and railroad tie 232, in addition to all other railroad ties between tapered end 222 and connection end 223 of point rail 205. While part of point rail 205 does engage one of the rollers in the second switch point roller assist apparatus 310, the contact is mostly non-weight-bearing in order to prevent damage to the switch point roller assist apparatus which is not designed to support the entire weight of a locomotive passing over the point rail 205.

Looking at point rail 204, it is seen that the point rail 204 is supported by the rollers 108*a–c* in roller cage 78 of switch point roller assist apparatus 10. The tapered end 220 of point rail 204 is thus raised above railroad tie plate 230, thus preventing frictional contact between railroad tie plate 230 and point rail 204. As point rail 204 is not in contact with main rail 200, a locomotive traveling over main rail 200 will not be transferred onto point rail 204, and thus point rail 204 does not bear any weight of the locomotive.

When switch 400 is thrown, throw rods 234 and 236 pull or push point switch rod 238 and first switch rod 214, and thus point rails 204 and 205 are moved from the position shown in FIG. 7 towards main rail 200. As point rail 205 is separated from outer turnout rail 218, point rail 205 rolls on the rollers of switch point assist apparatus 310 and is lifted slightly above railroad tie plate 230, thus facilitating movement of point rail 205. Point rail 204, on the other hand, moves on rollers 108*a–c* of switch point roller assist apparatus 10 rotating about connection end 221, until point rail 204 contacts main rail 200, as shown in FIG. 6. At this point, the tapered end 220 of point rail 204 rests on railroad tie plate 230, as point rail 204 has come down off of rollers 108*a–c* and only remains in contact and slightly on roller 108*a*, as shown in FIG. 6. A locomotive traveling on main rail 200 would thus be diverted onto point rail 204 and outer turnout rail 218, thus redirecting the locomotive onto a different track.

As can be seen from the above description, at no time during movement of the point rails 204 and 205 do the point rails 204 and 205 contact the railroad tie plate 230. In fact, point rails 204 and 205 do not contact railroad tie plate 230 until one or the other point rail 204 and 205 is in contact with the adjacent either main rail 200 or outer turnout rail 218.

The advantages of the present invention are even more noticeable when a manual-type switch is used, as the mechanical force which must be applied to move the point rails must be supplied by the operator of the switch. If frictional contact between point rails and the railroad tie plate is eliminated, the force required to move the point rails is greatly decreased. The risk of back injury and muscle strain can thus be substantially decreased. For informational purposes, manual-type switches commonly include only a single throw rod.

Figure 9:
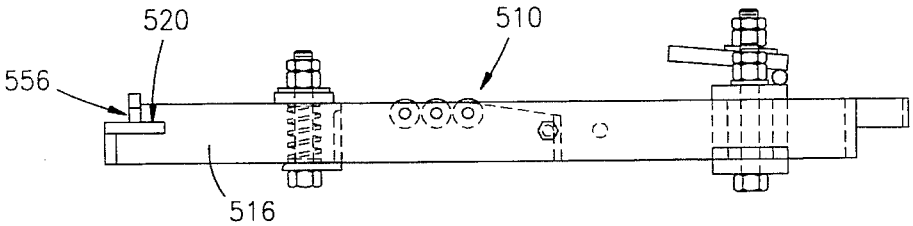
FIG. 9 is a side elevational view of the embodiment of FIG. 8.
Figure 10:
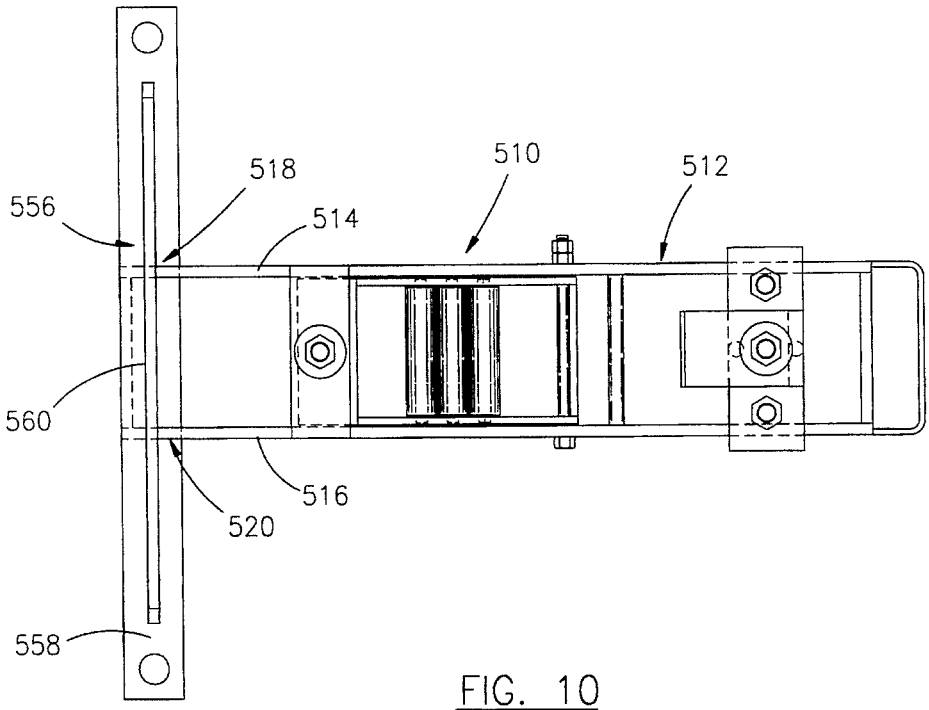
FIG. 10 is a top plan view of the embodiment of FIG. 8.

FIGS. 8–10 disclose a second embodiment of the present invention. While the majority of the second embodiment is substantially identical to the first embodiment of FIGS. 1–7 described previously, the second embodiment 510 would include a fixed-position tie bar 556 which is permanently affixed to the inner end 522 of the switch point roller assist apparatus 510. As can be seen in FIG. 8–10, tie bar 556 is substantially identical to tie bar 56 previously described, however, tie bar 556 is mounted on the first and second side bars 514 and 516 in a pair of contoured notches 518 and 520, one notch formed in each of the first and second side bars 514 and 516. As shown best in FIG. 9, each notch 518 and 520 is preferably contoured such that the outer side of flat bar 558 fits into each notch 518 and 520, with the entire width of flat bar 558 supported by a section of the first and second side bars 514 and 516. Stiffening beam 560 thus abuts the upper portion of the first and second side bars 514 and 516, as shown in FIGS. 9 and 10. Tie bar 556 may thus be securely fastened to first and second side bars 514 and 516 by welding or any other appropriate fastening means. Because this method of attachment of tie bar 556 to first and second side bars 514 and 516 does not allow for adjustment vertically or rotationally of the tie bar 556 with respect to the main support structure 512 of switch point roller assist apparatus 510, metal shims (not shown) may be inserted between the railroad tie to which the tie bar 556 is to be attached and the tie bar itself, thus enabling each end of the tie bar 556 to securely rest on the adjacent railroad ties. In all other respects, the second embodiment of switch point roller assist apparatus 510 is substantially identical to switch point roller assist apparatus 10 that was previously disclosed.

The present invention thus provides a substantial improvement over those switch point assist devices found in the prior art. First, the adjustable rail securement clamp location allows the switch point roller assist apparatus to be affixed to the main rail at the most optimum location. The location of the rollers with respect to the point rail thus may be correctly set. This allows the point rail to engage the first roller, thus preventing the need to raise the point rail onto the first roller when movement of the point rail is desired. Additionally, the adjustable connection of the tie bar to the main support structure enables the relative height of the tie bar with respect to the main support structure to be adjusted. Also, varying heights in the railroad ties themselves may be accommodated without requiring substantial modification of the railroad tie. Finally, because the height of the rollers with respect to the main support structure may be adjusted without moving or repositioning the main support structure, variations in point rail height above or below optimum positioning may be accommodated. The main support structure may thus remain unmodified while movement of the rollers may be effected. The present invention thus provides a substantial improvement over those devices found in the prior art.

It is to be understood that numerous modifications, additions and substitutions may be made to the present invention which fall within the intended broad scope of the appended claims. For example, the exact method by which the height of the rollers is adjusted is not critical, so long as adjustment of the rollers takes place without corresponding movement of the main support structure. Likewise, the exact design of the rail securement clamp is not critical, so long as the rail securement clamp may be secured in a particular position on the main support structure. It is thus to be understood that the above description is not intended in any way to limit the scope of the present invention, which is set forth in the claims below.

There has thus been set forth and described an invention which accomplishes at least all of the stated objectives.

We claim:

1. A switch point roller assist apparatus for attachment to a railroad rail at a switching location comprising;

an elongated main support structure having a center longitudinal axis and inner and outer ends;

rail securement means mounted on said main support structure adjacent said outer end for releasably connecting said main support structure to a railroad rail;

an elongated tie bar adjustably mounted on said main support structure adjacent said inner end generally perpendicular to said center longitudinal axis of said main support structure;

roller support means adjustably mounted on said main support structure;

at least one roller means having a center rotational axis, said roller means rotatably mounted on said roller support means such that said center rotational axis is generally perpendicular to said center longitudinal axis of said main support structure;

said tie bar adjustably mounted on said main support structure such that the position of said tie bar is vertically adjustable relative to said main support structure; and said roller support means adjustably mounted on said main support structure such that the position of said at least one roller means is vertically adjustable relative to said main support structure such that said roller may be fixed in multiple operative positions.

2. The switch point roller assist apparatus of claim 1 wherein said elongated main support structure comprises a generally rectangular frame having first and second side bars and inner and outer end bars, said inner and outer end bars extending between and connecting said first and second side bars such that said generally rectangular frame is constructed.

3. The switch point roller assist apparatus of claim 2 wherein said rail securement means comprises a rail securement clamp having a base plate and a top plate, said base plate positioned below said first and second side bars, said base plate and said top plate aligned generally perpendicular to said center longitudinal axis of said main support structure, said base plate and said top plate each having a length greater than the length of said inner and outer end bars whereby said base plate and said top plate each overhang said first and second side bars, said rail securement clamp further including adjustable connection means extending between and connecting said base plate and said top plate such that said base plate and said top plate may be moved towards one another thereby frictionally securing said clamp on said main support structure, said clamp further including rail flange engagement means for connecting said clamp to a railroad rail flange.

4. The switch point roller assist apparatus of claim 3 wherein said rail flange connection means comprises a rail flange connection plate adjustably mounted on said rail securement clamp, said plate including a base section adjustably connected to said clamp and a rail flange engaging section extending inwards towards said inner end of said main support structure beyond said top plate such that a rail flange may be seated and secured between said rail flange engaging section of said rail flange engagement plate and said first and second side bars of said main support structure.

5. The switch point roller assist apparatus of claim 2 wherein said roller support means further comprises an adjustable roller support structure including a pivotally mounted roller support cage and an adjustment structure.

6. The switch point roller assist apparatus of claim 5 wherein said roller support cage further comprises a generally rectangular frame including two generally parallel roller support side bars, a cage end bar extending between said roller support side bars at one end thereof and an end bracket extending between said roller support side bars opposite said cage end bar, said end bracket including an adjustment structure connection section for connection to said adjustment structure, said at least one roller rotatably mounted on said roller support side bars.

7. The switch point roller assist apparatus of claim 6 wherein said roller support cage is pivotally mounted on said first and second side bars of said main support structure adjacent said cage end bar such that said roller support cage may pivot about said pivotal connection between said roller support cage and said first and second side bars.

8. The switch point roller assist apparatus of claim 7 wherein said adjustment means further comprises an adjustment bolt mounted on said main support structure and connected to said adjustment structure connection section of said end bracket of said roller support cage whereby adjustment of said adjustment bolt moves said end bracket generally vertically thereby rotating said roller support cage about said pivotal connection between said roller support cage and said first and second side bars of said main support structure whereby the height of said at least one roller mounted on said roller support cage may be vertically adjusted relative to said main support structure.

9. The switch point roller assist apparatus of claim 2 wherein said adjustable mount between said tie bar and said main support structure comprises a generally vertical slot in said inner end bar of said main support structure, a bolt sleeve having a center longitudinal axis, said bolt sleeve mounted on said tie bar with said center longitudinal axis of said bolt sleeve generally parallel with said center longitudinal axis of said main support structure such that said bolt sleeve is mounted generally perpendicular to said tie bar, and a bolt extending through said slot and through said bolt sleeve and being secured therein, such that said tie bar may be adjusted vertically relative to said main support structure by sliding of said bolt vertically within said slot, and said tie bar being pivotally adjustable relative to said main support structure by rotation of said bolt sleeve about said bolt.

10. The switch point roller assist apparatus of claim 1 wherein said tie bar comprises an elongated flat bar having top and bottom surfaces and extending generally perendicular to said center longitudinal axis of said main support structure, said tie bar further including a stiffening beam mounted on said flat bar and extending generally parallel therewith, said stiffening beam operative to reduce bending deflection of said flat bar in response to force being applied thereto.

11. A switch point roller assist apparatus for attachment to a railroad rail at a switching location including a point rail, said apparatus comprising;

an elongated main support structure having a center longitudinal axis and inner and outer ends;

rail securement means mounted on said main support structure adjacent said outer end for releasably connecting said main support structure to a railroad rail;

an elongated tie bar mounted on said support structure adjacent said inner end generally perpendicular to said center longitudinal axis of said main support structure;

movement assist support means adjustably mounted on said main support structure;

movement assist means mounted on said movement assist support means for facilitating movement of a point rail from a first position to a second position; and said movement assist support means adjustably mounted on said main support structure such that the position of said movement assist means is vertically adjustable relative to said main support structure such that said movement assist means may be fixed in multiple operative positions.

12. The switch point roller assist apparatus of claim 11 wherein said tie bar is fixedly mounted on said main support structure adjacent said inner end.

13. The switch point roller assist apparatus of claim 12 wherein said movement assist support means further comprises an adjustable movement assist support structure including a pivotally mounted movement assist means support cage and an adjustment structure.

* * * * *